US008245404B2

(12) United States Patent
Minkes et al.

(10) Patent No.: US 8,245,404 B2
(45) Date of Patent: Aug. 21, 2012

(54) INNER CUTTER WITH CUTTER BLADES AT DIFFERENT RADII, METHOD FOR MANUFACTURING SUCH UNIT, SHAVER HEAD AND ROTARY SHAVER PROVIDED THEREWITH

(75) Inventors: Wllem Minkes, Drachten (NL); Bastiaan Johannes De Wit, Drachten (NL); Albert Jan Aitink, Drachten (NL)

(73) Assignee: Koninklijke Philips Electronics N.A., Eindhoven (NL)

( * ) Notice: Subject to any disclaimer, the term of this patent is extended or adjusted under 35 U.S.C. 154(b) by 518 days.

(21) Appl. No.: 11/718,384

(22) PCT Filed: Oct. 28, 2005

(86) PCT No.: PCT/IB2005/053532

§ 371 (c)(1),
(2), (4) Date: May 1, 2007

(87) PCT Pub. No.: WO2006/048805

PCT Pub. Date: May 11, 2006

(65) Prior Publication Data

US 2009/0025228 A1 Jan. 29, 2009

(30) Foreign Application Priority Data

Nov. 1, 2004 (EP) ..... 04105437

(51) Int. Cl.
*B26B 19/14* (2006.01)

(52) U.S. Cl. ..... 30/43.6; 30/346.51

(58) Field of Classification Search ..... 30/43.6, 30/346.51, 43.9, 43.92, 43.4, 43.5
See application file for complete search history.

(56) References Cited

U.S. PATENT DOCUMENTS

| | | | | | |
|---|---|---|---|---|---|
| 2,494,464 | A | * | 1/1950 | van de Lee et al. | 30/43.6 |
| 2,616,168 | A | | 11/1952 | Dankers | |
| 2,824,367 | A | * | 2/1958 | McWilliams | 30/41.5 |
| 3,116,551 | A | | 1/1964 | Anton | |
| 3,119,180 | A | | 1/1964 | Bruecker | |
| 3,919,770 | A | * | 11/1975 | Sakai et al. | 30/43.6 |
| 4,222,168 | A | * | 9/1980 | Boiten et al. | 30/43.6 |
| 4,240,199 | A | * | 12/1980 | Boiten et al. | 30/43.6 |
| 4,258,470 | A | * | 3/1981 | Boiten et al. | 30/43.6 |
| 4,275,497 | A | * | 6/1981 | Engelhardt et al. | 30/43.6 |
| 4,281,453 | A | * | 8/1981 | Bakker et al. | 30/43.6 |
| 4,283,849 | A | * | 8/1981 | Engelhardt et al. | 30/43.6 |
| 4,336,650 | A | * | 6/1982 | Gorter | 30/34.2 |
| 4,343,086 | A | * | 8/1982 | de Vries et al. | 30/43.6 |
| 4,393,586 | A | * | 7/1983 | Hamashima et al. | 30/43.6 |
| 4,490,907 | A | * | 1/1985 | Benedictus | 30/34.2 |
| 4,545,120 | A | * | 10/1985 | De Vries | 30/34.2 |
| 4,630,370 | A | * | 12/1986 | Hamada | 30/346.51 |
| 4,720,918 | A | * | 1/1988 | Curry et al. | 30/346.55 |
| 4,784,022 | A | * | 11/1988 | Asawa | 76/115 |
| 4,882,840 | A | * | 11/1989 | Tietjens | 30/43.6 |

(Continued)

FOREIGN PATENT DOCUMENTS

EP 1175972 1/2002

(Continued)

*Primary Examiner* — Kenneth E. Peterson
*Assistant Examiner* — Jennifer Swinney

(57) ABSTRACT

An inner cutter unit for a rotary shaver includes cutter blades arranged at different radii from a rotation axis of the unit. Depending on their respective positions within the unit, the respective cutter blades may be provided with different wedge angles and/or different bending resistance.

11 Claims, 2 Drawing Sheets

U.S. PATENT DOCUMENTS

| | | | | |
|---|---|---|---|---|
| 5,119,558 | A * | 6/1992 | van Erp et al. | 30/43.6 |
| 5,329,702 | A * | 7/1994 | Uchiyama et al. | 30/346.51 |
| 5,390,416 | A * | 2/1995 | Uchiyama et al. | 30/43.6 |
| 5,704,742 | A * | 1/1998 | Reinauer | 408/156 |
| 5,720,584 | A * | 2/1998 | Sijtstra | 409/12 |
| 6,199,282 | B1 * | 3/2001 | Uchiyama et al. | 30/43.6 |
| 6,398,467 | B1 * | 6/2002 | Herendeen et al. | 409/25 |
| 6,502,309 | B2 * | 1/2003 | De Vries et al. | 30/34.2 |
| 6,581,289 | B2 * | 6/2003 | Nakano | 30/43.6 |
| 6,769,179 | B2 * | 8/2004 | Satoh et al. | 30/43.6 |
| 6,823,590 | B2 * | 11/2004 | Uchiyama et al. | 30/43.6 |
| 6,868,611 | B2 * | 3/2005 | Geertsma et al. | 30/43.6 |
| 7,152,324 | B2 * | 12/2006 | Uchiyama | 30/43.6 |
| 7,178,242 | B2 * | 2/2007 | Okabe | 30/43.6 |

FOREIGN PATENT DOCUMENTS

| | | |
|---|---|---|
| EP | 1354676 A1 | 10/2003 |
| FR | 1101734 | 10/1955 |

* cited by examiner

INNER CUTTER WITH CUTTER BLADES AT DIFFERENT RADII, METHOD FOR MANUFACTURING SUCH UNIT, SHAVER HEAD AND ROTARY SHAVER PROVIDED THEREWITH

The invention relates to an inner cutter unit for a rotary shaver, more particularly an inner cutter unit comprising a plurality of cutter blades, arranged at different radii from a rotation axis of said unit.

Such inner cutter units are known, for instance from U.S. Pat. No. 5,390,416. Each inner cutter unit is combined with an outer cutter unit, which rests on the cutter blades and is provided with hair-entry apertures. The cutter blades are slightly slanted forward, in rotation direction. During use, the inner cutter unit is rotated along a bottom side of the outer cutter unit, thereby cutting any hairs entering the apertures.

A problem with this known arrangement is that during use, a cutting gap may arise between the inner and outer unit. This gap affects the shaving performance, as it hampers a proper cutting action between the inner and outer cutter unit. This can be seen as follows. During use, when cutting a hair, a cutter blade may be temporarily urged towards a more upright position, under influence of forces exerted thereon by said hair. Due to such deformation, the cutter blade will become higher than the surrounding cutter blades, causing the outer cutter unit to be lifted and tilted around said local lifting point. This will create a gap between the outer cutter unit and at least some of the cutter blades. Due to the amplifying effect of the tilt angle, this gap will be largest for the cutter blades near the outer circumference, which is all the more disturbing as these cutter blades normally contribute most to the shaving performance thanks to their high tangential cutting speed.

A further disadvantage of the known inner cutter unit is that it is not adapted to different shaving conditions, to which different parts of the cutter unit may be exposed during use. Such differences may for instance be due to skin-doming or the different ways in which the hairs can be presented to the cutter blades, which may for instance depend on the location of the cutter blades in the cutter unit and/or the design of the hair-entry apertures.

It is therefore an object of the invention to provide an inner cutter unit of the above-described type, wherein at least one of above-mentioned problems is avoided or at least mitigated.

By providing each cutter blade with a wedge angle based on its position within the cutter unit, said angle may be optimized for the specific shaving conditions the cutter blade in question is likely to encounter. As such, the cutter blades may be better tuned for their respective tasks.

For instance, cutter blades extending at similar radii from a rotation axis of the cutter unit will feature similar tangential cutting speeds. Moreover, such blades may, during use, experience comparable contact pressures, when the shaver is pressed against a user's skin. Hence, these cutter blades are likely to face comparable shaving conditions and as such, it may be beneficial to provide said cutter blades with substantially the same wedge angles, catered for said specific shaving conditions.

A similar reasoning may apply for cutter blades extending in a particular circle segment of the cutter unit. These blades too are likely to share some shaving conditions for which a specific, most advantageous wedge angle can be selected.

In this description, the wedge angle of a cutter blade is defined as the angle enclosed between an upper surface of the cutter blade and a lower surface of said blade, intersecting each other at the cutting edge of the cutter blade.

In a preferred embodiment, the cutter blades extending near the rotation axis of the cutter unit are provided with a relatively large wedge angle or at least a wedge angle which is larger than those of the circumferential cutter blades. For example, the central cutter blades may have a wedge angle of about 70° to 85° whereas the circumferential cutter blades may have a wedge angle of about 40° to 50° (these values are given for illustration purposes only and in no way to be construed as limiting). Thanks to such large wedge angles and the accompanying upright disposition of the central cutter blades, no large variations in height will occur when said blades are urged to an even more upright position, during use, under influence of cutting forces acting thereon. Hence, the outer cutter unit will not or hardly be lifted and gap forming will be negligible.

A comparable advantage may be achieved by providing the central cutter blades with a high resistance against bending, for instance by proper design and/or material selection. In this way, when loaded during use, these blades will hardly bent, and cause no or little variations in height. Of course, a combination of abovementioned features is possible, wherein the central cutter blades have a large wedge angle and a high bending resistance.

The invention furthermore relates to a method for manufacturing a cutter unit where the cutter blades can be readily provided with different wedge angles, simply by arranging the respective cutter blades under desired angles and by subsequently machining the upper surface of the unit, thereby removing excess material from the cutter ends and, at the same time, providing these ends with an appropriate wedge angles.

The invention also relates to a shaver head comprising an inner cutter unit according to the invention and an outer cutter unit, wherein the thickness and apertures of the outer cutter unit are adapted to the wedge angles of the corresponding inner cutter blades, or vice versa. For instance, if the wedge angle is relatively small and consequently the cutting edge is rather sharp, the thickness of the outer cutter unit may be increased and/or the dimensions of the hair-entry apertures may be reduced, in order to prevent or minimize any contact between said cutter blades and a user's skin. If on the other hand the cutting edge is rather blunt, due to a relatively large wedge angle, the thickness of the outer cutter unit may be reduced, allowing for a close shave.

The invention furthermore relates to a rotary shaver comprising at least one shaver head and/or inner cutter unit according to the invention.

To explain the invention, exemplary embodiments thereof will now be described with reference to the accompanying drawings, wherein.

In this description, identical or corresponding parts have identical or corresponding reference numerals.

Figure 1:
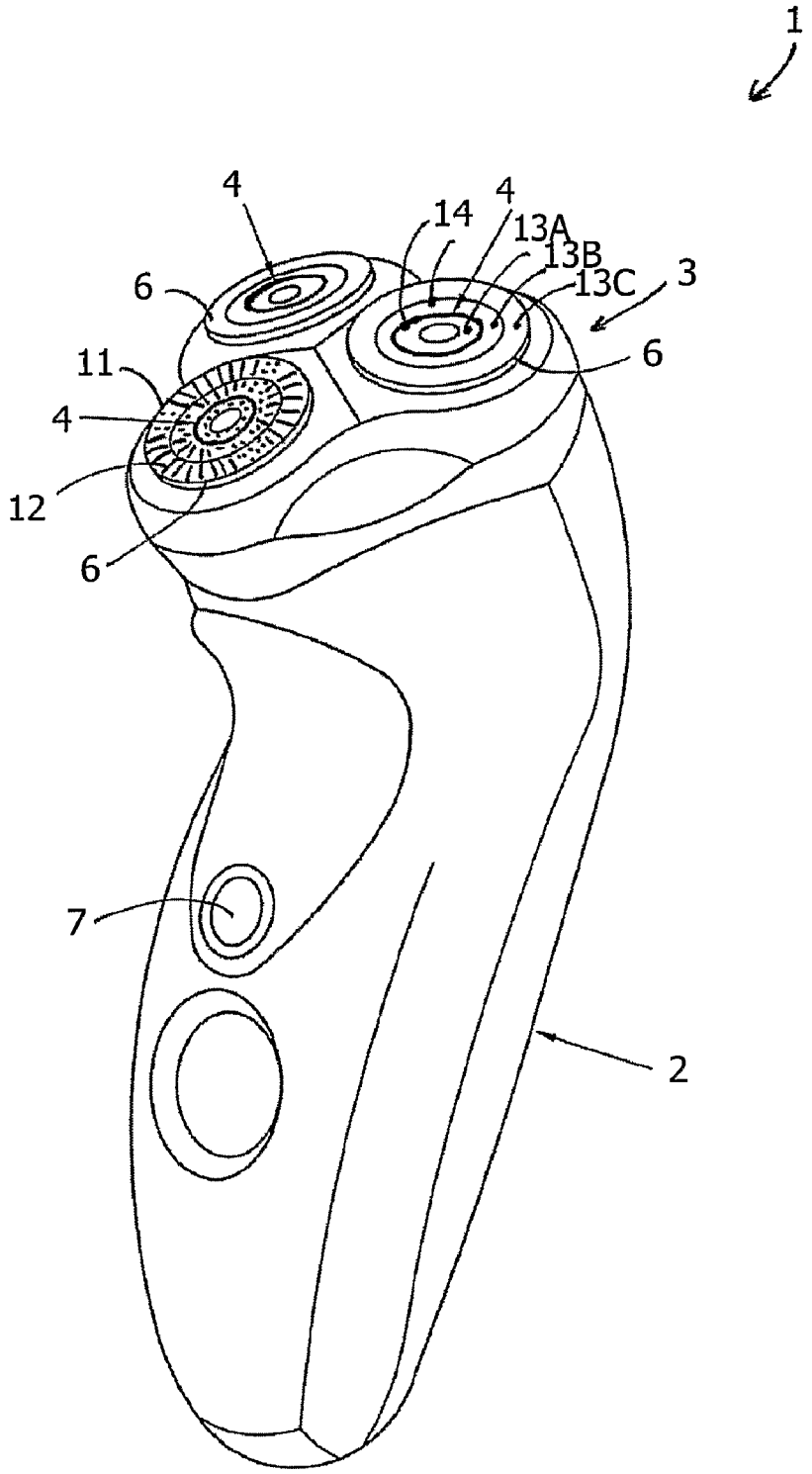
FIG. 1 shows in perspective view a rotary shaver according to the invention, provided with three shaving heads, having concentric annular shaving sections.

FIG. 1 shows a typical example of a rotary shaver 1, comprising a housing 2, provided with a shaver head holder 3, which includes three shaver heads 4. Each shaver head 4 comprises a cap or outer cutter unit 6, which in use is brought into contact with a user's skin, and an inner cutter unit 5, which is rotatably mounted in the shaver head holder 3, below the outer cutter unit 6, and in use is driven by a motor and suitable transmission means (not shown), accommodated in the housing 2. The housing 2 may further accommodate a power supply (not shown) and a power switch 7.

Each outer cutter unit 6 is provided with a number of hair entry apertures 11, 12 and two concentric annular grooves 14 (or ribs), which divide the cap 6 into three concentric shaving sections 13A-C. These sections 13A-C form, at their bottom side, between the grooves 14, tracks in which cutter blades of the abovementioned inner cutter unit 5 can rotate, thereby co-operating with the edges of said apertures 11, 12 to cut off any hairs or stubs entering said apertures 11, 12. The grooves or ribs 14 have a stiffening effect on the outer cutter unit 6. Consequently, the wall thickness of said unit 6 may be reduced locally, thereby allowing hairs to be cut closer to the skin. Alternatively or additionally the number of hair-entry apertures 11, 12 may be increased, which enables hairs to enter the outer unit 6 more readily and which moreover increases the number of edges for the cutter blades to cooperate with, to severe entering hairs.

As furthermore shown in FIG. 1, the hair-entry apertures can be of different design, for instance round 11 or slit-shaped 12. The round apertures 11 are in the given example concentrated in the center of the cap 6, where the tangential cutting speed in use will be lowest. These apertures 11 are generally believed to be most efficient for cutting stubs, since thanks to their limited size, the local wall thickness of the outer unit 6 may be very thin, allowing the stubs to be shaved very close to the skin. The slits 12 on the other hand, are generally believed to be good in trapping and re-orienting longer hairs, and are therefore in the present embodiment located more towards the circumferential edge of the outer unit 6, where in use the (tangential) cutting speed will be highest. Of course, in alternative embodiments, the shapes, combinations and/or distribution of the apertures 11, 12 may be varied. Also, the outer unit 6 may be provided with more or less annular sections 13.

Figure 2:
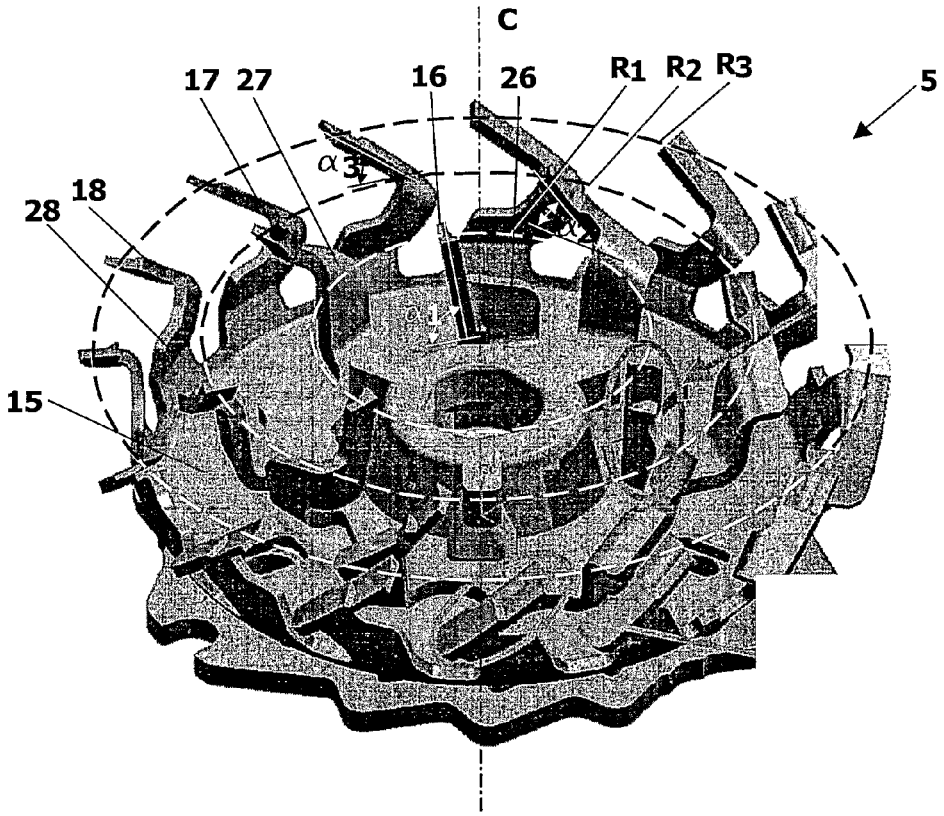
FIG. 2 shows in perspective view an inner cutter unit according to the invention, with cutter blades featuring different wedge angles.

The inner cutter unit 5 will now be described in more detail with reference to FIG. 2, showing an example of such a unit 5 having a plurality of cutter blades 16, 17, 18 extending at three different radii $r_1$, $r_2$, $r_3$ from a rotation axis C of the unit 5, thereby forming three substantially concentric rings $R_1$, $R_2$, $R_3$. It will be clear that the number of rings may be varied, as may the number of cutter blades per ring. The inner cutter unit 5 as illustrated is fit to cooperate with the before-mentioned three tracks 13A-C of the outer cutting unit 6.

The cutter blades 16, 17, 18 are connected to a central base plate 15 by means of a plurality of arms 26, 27, 28, preferably (but not necessarily) one cutter blade per arm. These arms 26-28 and blades 16-18 may be integrally cut from a single blank, after which some of the arms 27, 28 may be bent radial outward and others 26 may be bent radial inward, so as to arrange the cutter blades 16-18 at the different radii $r_1$, $r_2$, $r_3$ from the rotation axis C. Alternatively, the unit 5 may be assembled from a series of separate cutter members, each member being equipped with a number of cutter blades and arms, which may be cut and bent from a single blank, and which cutter members are subsequently nested into one another, so as to form a unit 5 with multiple concentric cutter rings $R_1$, $R_2$, $R_3$. Of course, a combination of above-mentioned techniques is possible, wherein the arms 26-28 of the individual, nested cutter members may be bent radial outward and/or inward so as to form multiple rings. For a detailed description, reference is made to the patent applications "Cutter member for a rotary shaver, method for making such a member and rotary shaver provided therewith" and "Cutter unit for a rotary shaver, method for making such a unit and rotary shaver provided therewith" of applicant, both filed on the same date as the present application and both incorporated herein by reference.

As clearly visible in FIG. 2, the cutter blades 16-18 have a slanted orientation with regard to a plane extending radial from the rotation axis C, substantially perpendicular to the base plate 15. This slanted orientation determines the wedge angle $\alpha$ of said cutter blades, as will be explained with reference to FIG. 3. The wedge angle $\alpha$ is defined as the angle of the cutting edge 20 of the cutter blade, or more particular, the angle enclosed between a top surface 22 and a lower surface 24 of said cutting edge 20. As can be seen from FIG. 3, this wedge angle $\alpha$ corresponds to the angle a longitudinal axis $L_{1,3}$ of the cutter blade encloses with the central base plate 15.

One way to realize an inner cutter unit 5 with the desired wedge angles $\alpha_{1,3}$ is to bend the cutter arms 26-28 so as to have the cutter blades 16-18 extend under the desired angle $\alpha$ with the base plate 15. Subsequently, the top surface of the cutter unit 5, formed by the respective top ends of the cutter blades 16-18, may be machined, for instance by spark erosion, so as to provide the inner unit 5 with a top surface that matches the bottom surface of the outer cutter unit 6, which may for instance have a flat or curved shape, e.g. concave or convex. At the same time, excess material is removed from the top ends of the cutter blades, thereby forming surfaces 22 and giving the cutter blades 16-18 their desired wedge angles $\alpha_{1,3}$.

Referring again to FIG. 2, it can be seen that the cutter blades 18 in the outer ring $R_3$ comprise a relative small wedge angle $\alpha_3$, corresponding to a sharp cutting edge 20 with good cutting properties. From this it would appear logical to provide all cutter blades 16, 17 in the other rings $R_1$, $R_2$ with a similar small wedge angle, for optimal cutting behavior. However, according to the invention, the cutter blades 17 and 16 have been given larger wedge angles $\alpha_2$, $\alpha_3$, corresponding to a more upright configuration and a more blunt cutting edge 20.

Figure 3:
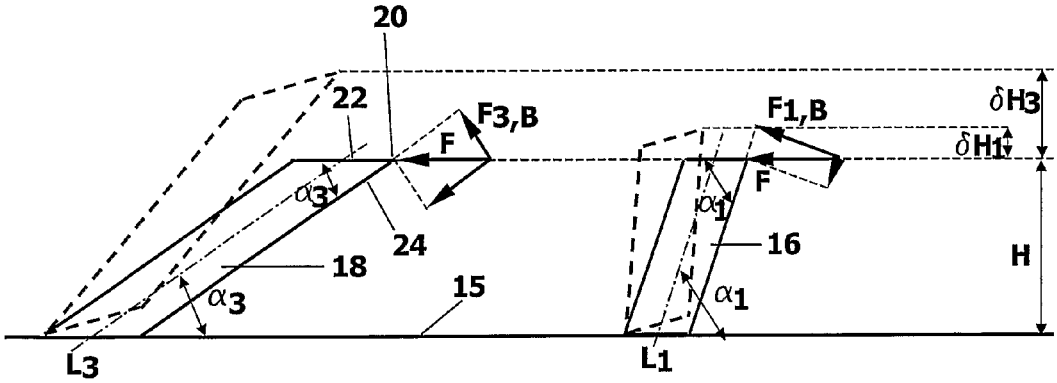
FIG. 3 shows schematically, in side view, two cutter blades of the cutter unit of FIG. 2, each with a different wedge angle.

The advantage of such a large wedge angle will be explained with reference to FIG. 3, showing (very schematically) two cutter blades 16, 18 in particular a central blade 16, with a relatively large wedge angle $\alpha_1$ and a circumferential blade 18, with a relatively small wedge angle $\alpha_3$. Both blades 16, 18 initially have the same height H. In use, when impacting a hair (not shown), the blades 16, 18 will be exposed to a reaction force of said hair, represented by arrow F. A component $F_B$ of this force, extending substantially perpendicular to a longitudinal axis $L_{1,3}$ of the respective cutter blades 16, 18 will urge the cutter blades 16, 18 towards a more upright position, as illustrated in dotted lines. Although the urging component $F_{1,B}$ acting on the central blade 16 is larger than that acting on the circumferential blade 18, the distance between the point of contact of said components and the central base 15 (measured in the direction of the respective longitudinal axis $L_{1,3}$) is clearly much smaller for blade 16 than for blade 18, so that the bending moment will be much smaller as well, as a consequence of which the urging component $F_{1,B}$ will affect the central blade 16 less than the circumferential blade 18. Moreover, it can be seen, that when both blades 16, 18 are rotated around a similar angle (which in FIG. 3 is highly exaggerated) the central blade 16 will feature only a small increase in height $\delta H_1$ as compared to a rather large increase $\delta H_3$ of the circumferential cutter blade 18. Thanks to these two effects (small deflection, minimum height variation) of the central blade 16, the gap-forming problem of the known cutter units, as discussed in the introductory part of this description, will be greatly reduced if not solved altogether.

It is noted, that the fact that the central cutter blades 16 loose some of their cutting capacity, due to their relative large wedge angle, will not seriously affect the overall shaving performance of the shaver, as the contribution of these central cutter blades 16 to said shaving performance is relatively small in comparison to that of the circumferential blades 17, 18, due to the higher tangential cutting speed of the latter.

In a preferred embodiment, the design of the outer cutter unit 6 may be adapted to the shape, in particular the wedge angles of the inner cutter blades 16-18. For instance, where the wedge angles $\alpha$ are small, and hence the cutting edges 20 are sharp, the wall thickness of the outer unit 6 may be locally increased, so as to prevent direct contact between the sharp blades and a user's skin, which could give rise to skin irritations. Where the wedge angles are relatively large and consequently the cutting edges 20 are relatively blunt, the thickness of the outer cutter unit 6 may be locally reduced, allowing a very close shave.

Of course, under other conditions, where the shape of the outer cutter unit 6 is given or predetermined, the wedge angles of the underlying cutter blades 16-18 may be adapted, in a similar way as discussed above. Moreover, the wedge angles may be adapted so as to suit certain shaving criteria, such as for example minimum skin irritation, minimum gap forming and/or maximum shaving smoothness, etc. Depending on the chosen criteria it may be beneficial to provide the circumferential cutter blades with the largest wedge angles instead of the central cutter blades.

In the illustrated example the wedge angles $\alpha$ of the cutter blades 16-18 varied per ring $R_1$, $R_2$, $R_3$. Of course, different distributions are feasible. For instance, the most central cutter blades 16 may be provided with a relative large wedge angle, whereas all other blades 17, 18 may be provided with a similar, relatively small wedge angle. Alternatively or additionally, the cutter unit may be divided in circle segments, wherein each segment has its own wedge angle.

Instead of the wedge angle, or in addition thereto, other parameters of the cutter blades 16-18 and/or hair-entry apertures 11, 12 may be varied depending on their position in the inner and outer cutter unit 5, 6. For instance, the gap forming problem may be reduced by increasing the bending resistance of the cutter blades, for example by making their base more sturdy or by selecting a stiffer material. For example, the bending resistance of the cutter blades (16, 17, 18) increases as its radius $R_1$, $R_2$,$R_3$) to the rotation axis (C) decreases. Thus, a first bending resistance against bending of a first cutter blade 16 near the rotation axis C is more than a second bending resistance against bending of a second cutter blade 17, 18 further from the rotation axis C than the first cutter blade 16. To minimize skin irritations, the cutting edge of the cutter blades may be provided with rounded edges or a torus, depending on the location of said cutter blades within the cutter unit. If the cutter units are provided with biasing means, for maintaining a certain contact pressure between the shaving head and a user's skin, these biasing means or pressure may be varied for different parts of the cutter unit 5. Some cutter blades may be provided with suitable hair pulling means, arranged to pull hairs towards the base plate 15, so that the cutter blades can cut those hairs closer to the skin.

Of course, many other parameters may be adapted, in a similar way. Thus it is possible to optimally adjust the cutter units 5, 6 to different shaving conditions, to which different parts of the cutting units 5,6 may be exposed, for instance due to the fact that the skin doming may be quite different near the center of the cutter unit, as compared to near its edge. Also, hairs can enter the units in different ways and consequently be presented to the cutter blades differently.

The invention is not in any way limited to the exemplary embodiments presented in the description and drawing. Many variations thereon are possible. These variations, as well as all combinations (of parts) of the embodiments shown and described in this description are explicitly understood to be incorporated in this description and to fall within the scope of this invention, as outlined by the following claims.

The invention claimed is:

1. An inner cutter unit for a rotary shaver, the inner cutter unit comprising:

a base plate;

a rotation axis; and a plurality of cutter blades permanently connected to the base plate for cutting hair arranged at different radii from a rotation axis of said inner cutter unit, wherein a wedge angle of the plurality of cutter blades is selected in relation to their respective positions within the inner cutter unit, a first wedge angle of a first cutter blade for cutting hair near the rotation axis being different from a second wedge angle of a second cutter blade for cutting hair further from the rotation axis than the first cutter blade, and wherein a first bending resistance against bending of the first cutter blade is more than a second bending resistance against bending of the second cutter blade.

2. The inner cutter unit according to claim 1, wherein cutter blades of a first set of blades arranged at similar radii from the rotation axis have similar wedge angles.

3. The inner cutter unit according to claim 1, wherein cutter blades of a first set of blades radially aligned or arranged within a specific circle segment have similar wedge angles.

4. The inner cutter unit according to claim 1, wherein neighboring cutter blades, in radial and/or tangential direction, have different wedge angles.

5. The inner cutter unit according to claim 1, wherein cutter blades near the rotation axis have a larger wedge angle than a wedge angle of cutter blades near a circumference of the inner cutter unit.

6. The inner cutter unit according to claim 1, wherein a bending property of a cutter blade is selected in relation to a position of the cutter blade within the inner cutter unit.

7. A shaver head comprising;

a rotation axis;

an inner cutter unit including a base plate and a plurality of cutter blades permanently connected to the base plate for cutting hair arranged at different radii from a rotation axis of said inner cutter unit, wherein a wedge angle of the plurality of cutter blades is selected in relation to their respective positions within the inner cutter unit, a first wedge angle of a first cutter blade for cutting hair near the rotation axis being different from a second wedge angle of a second cutter blade for cutting hair further from the rotation axis than the first cutter blade; and an outer cutter unit having hair-entry apertures, wherein a number and geometry of the hair-entry apertures and/or a local wall thickness of the hair-entry apertures is selected in relation to a wedge angle of cutter blades underlying the hair-entry apertures, and wherein a first bending resistance against bending of the first cutter blade is more than a second bending resistance against bending of the second cutter blade.

8. The shaver head according to claim 7, wherein the wedge angle of a cutter blade is chosen in relation to proximity of the cutter blade, in use, to a user's skin, wherein the wedge angle is chosen larger with increased proximity.

9. A rotary shaver, comprising at least one shaver head according to claim 7.

10. The shaver head of claim 7, wherein a thickness of the outer cutter unit is increased with increasing radial distance from the rotation axis.

11. The shaver head of claim 7, wherein dimensions of the hair-entry apertures are reduced with increasing radial distance from the rotation axis.

* * * * *